US006011397A

United States Patent [19]

Yasuda

[11] Patent Number: 6,011,397

[45] Date of Patent: Jan. 4, 2000

[54] ION CURRENT DETECTION DEVICE FOR INTERNAL COMBUSTION ENGINE

[75] Inventor: Yukio Yasuda, Tokyo, Japan

[73] Assignee: Mitsubishi Denki Kabushiki Kaisha, Tokyo, Japan

[21] Appl. No.: 08/892,195

[22] Filed: Jul. 14, 1997

[30] Foreign Application Priority Data

Mar. 11, 1997 [JP] Japan ..... 9-056105

[51] Int. Cl.[7] ..... F02P 17/00

[52] U.S. Cl. ..... 324/388; 324/399; 73/35.08

[58] Field of Search ..... 324/388, 389, 324/380, 383, 382, 390, 391, 393, 399; 73/117.2, 117.3, 35.08

[56] References Cited

U.S. PATENT DOCUMENTS

| | | | |
|---|---|---|---|
| 4,382,233 | 5/1983 | Hofer | 330/107 |
| 5,548,220 | 8/1996 | Kawamoto et al. | 324/399 |
| 5,561,239 | 10/1996 | Yasuda | 324/399 X |
| 5,652,520 | 7/1997 | Kawamoto et al. | 324/388 |
| 5,675,072 | 10/1997 | Yasuda et al. | 324/379 X |

FOREIGN PATENT DOCUMENTS

| | | |
|---|---|---|
| 57-111114 | 10/1982 | Japan . |
| 63-240114 | 10/1988 | Japan . |
| 2-128510 | 5/1990 | Japan . |
| 9-015101 | 1/1997 | Japan . |

*Primary Examiner*—Josie Ballato
*Assistant Examiner*—T. R. Sundaram

[57] ABSTRACT

An ion current detection device of an internal combustion engine includes a detection voltage generation device which applies a voltage to an ignition plug to generate an ion current in a cylinder of the engine. A current to voltage conversion circuit detects and converts the generated ion current to a voltage signal. A bandpass filter extracts an ac component within a specified frequency range from the voltage signal produced by the current to voltage conversion circuit. An ion current threshold detection portion produces an ion current detection signal when the detected ion current exceeds a predetermined threshold current. A filter characteristic control circuit controls the characteristic of the bandpass filter to suppress the sensitivity of the filter for a predetermined period of time right after the ion current detection signal is detected and, after the predetermined period of time, increase the sensitivity of the filter for detection of the ac signal with the specific frequency.

17 Claims, 12 Drawing Sheets

Fig.8
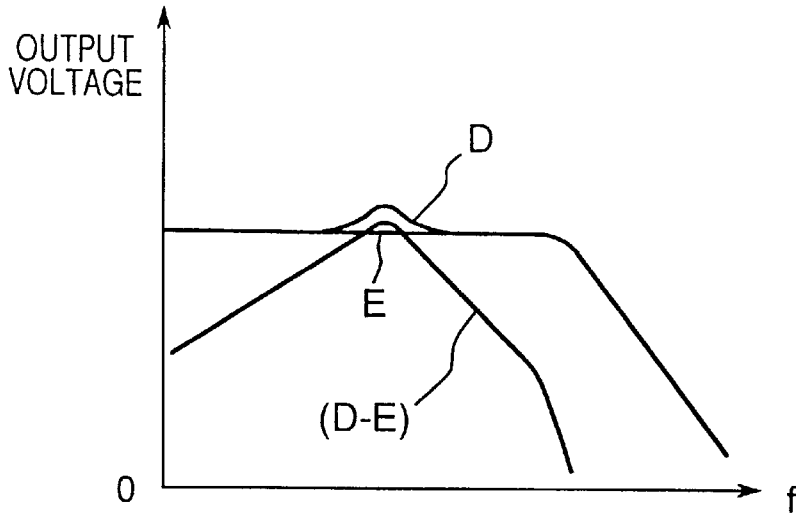
Fig.9A
Fig.9B
Fig.9C
Fig.9D
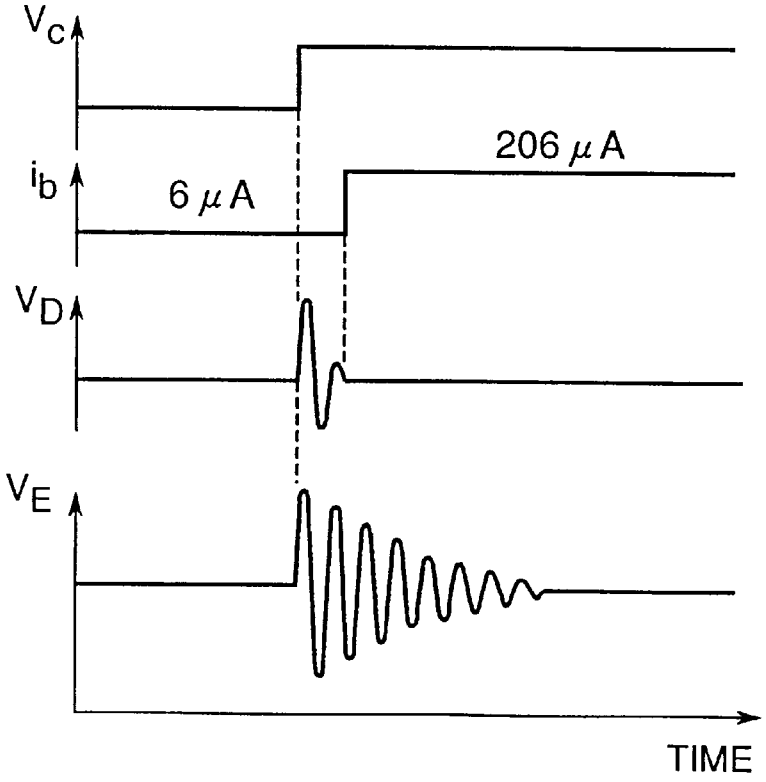

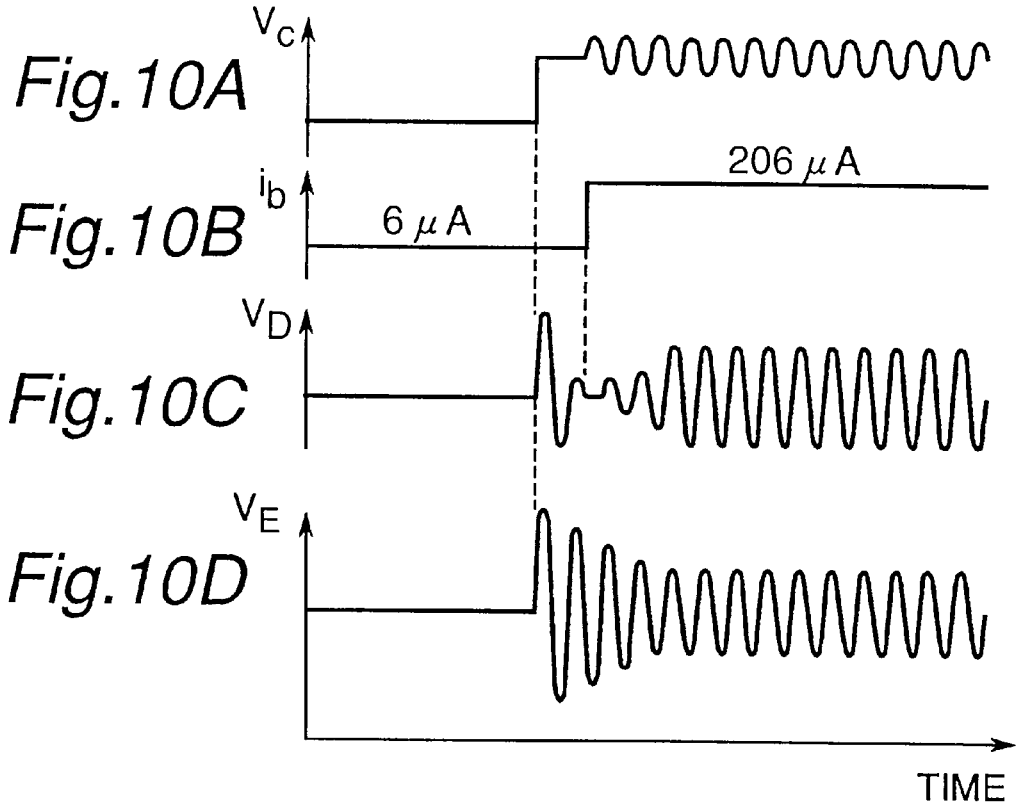
Fig.11
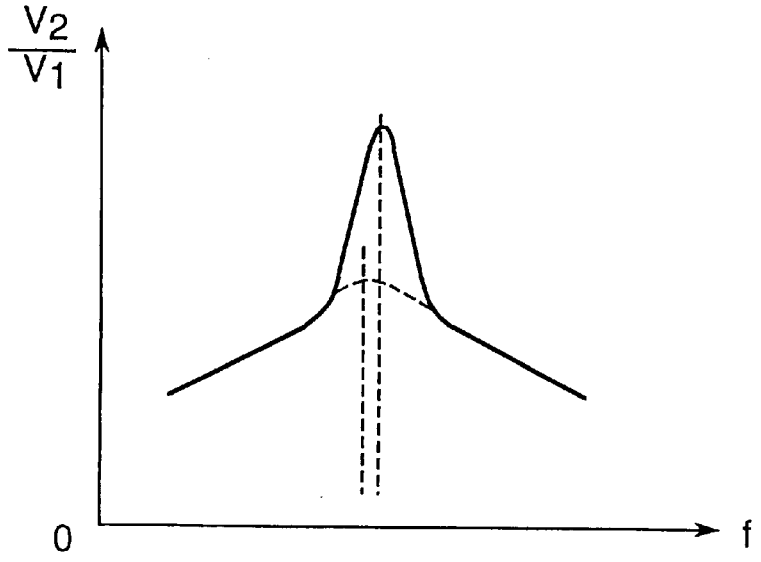

ION CURRENT DETECTION DEVICE FOR INTERNAL COMBUSTION ENGINE

BACKGROUND OF THE INVENTION

1. Field of the Invention

The present invention relates to an ion current detection device which detects the ion current caused by ionized combustion gas within an internal combustion engine in order to detect combustion states in cylinders of the engine.

2. Description of the Prior Art

An ignition type internal combustion engine (referred to as an engine hereinafter) produces power by compressing a fuel gas mixed with air in a combustion chamber (referred to as a cylinder hereinafter) with a piston and then igniting the mixed gas with an ignition plug. The power derived from the engine depends on the ignition timing with regard to the position of the piston. Generally an earlier ignition produces higher power. Too early an ignition, however, causes an abnormal combustion, referred to as knocking, which may result in damage to the engine. In order to avoid knocking, a conventional engine is provided with an oscillation sensor for detecting oscillation of the engine and determines an occurrence of knocking based on the signal from the oscillation sensor. The engine then delays the ignition timing so that an ignition occurs just outside the timing range where knocking would occur.

Knocking occurs in a cylinder. Detecting oscillation from a plurality of cylinders with high sensitivity largely depends on where the oscillation sensor is placed. The optimum position of the oscillation sensor for detecting the oscillation of all cylinders without interference from other oscillation, such as from the intake and exhaust valves, varies from one type of engine to another and is an important issue in engine design.

When combustion of the mixed gas occurs in the cylinder, the gas is ionized. Therefore, a voltage applied between electrodes placed in the cylinder causes an electric current to pass through it, which is referred to as the ion current. Since the ion current sensitively varies depending on the states of combustion in the cylinder, the measurement of the ion current provides information about the states of combustion.

The ion current rapidly increases in magnitude after ignition, reaching an maximum in a short period of time, and then decays relatively slowly. When knocking occurs, an additional component of a few kHz is superimposed on the ion current. Therefore, detecting knocking includes extracting only the oscillating component caused by the knocking from the rapidly changing ion current.

As mentioned above, the ion current is produced by the ionized gas in combustion triggered by ignition. Thus, its magnitude varies depending on the ignition condition and the engine speed. Normally, the ion current lasts for a period between a few msec and a few tens of msec. The oscillating component superimposed on the ion current due to knocking starts a few hundred $\mu$sec after the ion current starts and is large in the first half of the ion current duration period. Therefore, an efficient measurement of the superimposed oscillating component must be made as soon as the ion current starts to flow. Since the ion current increases very rapidly, the ion current entering a band-pass filter with a sharp filter characteristic formed with an operational amplifier, for example, will cause a ringing at frequencies near the peak frequency of the band-pass filter immediately after the ion current starts to rise if a high frequency cut filter is not used. It should be noted that if the band-pass filter characteristic is sharper, the ringing is generated more easily and lasts longer.

Thus the ringing creates signals similar to the oscillating component of the ion current at the output of the band-pass filter, and hence precludes an accurate measurement of the knocking signal. This means that the detection of the knocking cannot be made until the oscillating signal due to the ringing becomes sufficiently small compared with the oscillating signal due to the knocking. The knocking cannot be detected during this period of time. It is well known, however, that the band-pass filter, which is designed to minimize the duration of the ringing, cannot detect knocking.

The applicant of the present invention disclosed in the patent application HEI 7-163869 a system for detecting knocking which utilizes ignition plugs as electrodes to measure the ion current. This knocking detector exhibits less performance variation among different types of engines than an oscillation sensor and thus provides for an accurate control system which no longer requires the oscillation sensor.

FIG. 18 illustrates a circuit diagram of the aforementioned ion current detection device. Referring to FIG. 18, an ignition device 201 of the simultaneous firing type is connected to an ion current detection device 202, which comprises a detection voltage generation circuit 203, an ion current/voltage conversion circuit 204, an ion current threshold detection circuit 205, a timer 206, a masking circuit 207, and an ac component detection circuit 208.

The detection voltage generation circuit 203 charges a capacitor C1 by the counter electromotive force induced when the transistor T1 of the ignition device 201 shuts off the current flowing through the primary coil L1 of the ignition coil L. Then the charge stored in the capacitor C1 produces a positive voltage on the ignition plugs PG1 and PG2 after the ignition discharge has occurred. The ion current/voltage conversion circuit 204 converts the ion current signal, which the detection voltage generation circuit 203 creates by applying the positive voltages at the ignition plugs PG1 and PG2, to a voltage signal comprising a low frequency component with an almost constant voltage and a high frequency component caused by knocking.

The ion current threshold detection circuit 205 compares the ion current which the detection voltage generation circuit 203 creates by applying the positive voltages at the ignition plugs PG1 and PG2 with a predetermined threshold current to determine whether or not the ion current is larger than the threshold current. If it finds that the ion current is larger than the threshold current, it produces an ion current detection signal. The timer 206 transmits the ion current detection signal produced by the ion current threshold detection circuit 205 with a predetermined time delay to control the transistor T2.

The masking circuit 207 removes the high frequency component from the voltage signal obtained by the ion current/voltage conversion circuit 204 which cannot be removed by the operational amplifiers because of its poor circuit responsiveness. The masking circuit 207 then amplifies the filtered signal and sends the sufficiently large signal to the ac component detection circuit 208. The masking circuit 207 also mask-controls the voltage signal provided by the ion current/voltage conversion circuit 204 responding to the operation of the transistor T2. That is, the masking circuit 207 amplifies the signal from which the high frequency component is removed in a predetermined time delay after the ion current threshold detection circuit 205 detects the ion current larger than the threshold current. Then the masking circuit 207 sends the amplified signal to the ac component detection circuit 208, which, comprising a band-pass filter, extracts the knocking signal included in the high frequency component which was amplified by the masking circuit 207.

The circuit shown in FIG. 18 comprises a feedback circuit utilizing operational amplifiers which, when an ion current larger than the predetermined threshold current flows, produces a constant voltage regardless of the magnitude of the ion current and which has a small feedback gain for the signal with the specific frequency associated with the knocking. The feedback circuit enhances the relative magnitude of the knocking current component with the specific frequency within the ion current signal. The ion current signal, including the enhanced knocking current component, passes through the filter comprising capacitors and resistors. Then only the knocking signal is extracted from the ion current by means of the band-pass filter comprising operational amplifiers.

As indicated above, a highly efficient band-pass filter generates a ringing near the peak frequency when a rapidly changing signal such as a step signal is introduced to the filter. Therefore, processing of the ion current with the band-pass filter without preprocessing it gives rise to a ringing immediately after the ion current is generated, thereby resulting in a false detection of the knocking current causing the system to falsely determine that a knocking has occurred even if it has not.

Further, the ion current detection device shown in FIG. 18 requires many operational amplifiers. Therefore, it is large and expensive.

The ion current detection device shown in FIG. 18, having the capability to detect a knocking signal, shuts off the signal entering the band-pass filter immediately after the ion current is generated but allows for the signal to enter the band-pass filter after a predetermined time delay. The masking circuit 207, which shuts off the signal entering the band-pass filter, includes capacitors and resistors to smooth the signal entering the band-pass filter so that the signal does not change rapidly after the shut-off circuit ceases to operate. This configuration is complex, and a new configuration which is simpler and yet can avoid the ringing is desired.

SUMMARY OF THE INVENTION

An object of the present invention, therefore, is to solve the above problems and to provide an ion current detection device for an internal combustion engine which is compact, has simplified circuits, is inexpensive, and does not detect the false knocking associated with the ringing.

The ion current detection device of the present invention detects the ion current which is generated when fuel burns in an internal combustion engine comprising ignition coils for inducing a high voltage on the secondary coils with a voltage applied to the primary coils, ignition plugs for igniting fuel by means of the high voltage induced in the ignition coils, and cylinders. The ion current detection device comprises:

a detection voltage generation circuit for applying a voltage to an ignition plug to generate an ion current in a cylinder of the engine;

a current to voltage conversion circuit for converting the generated ion current to a voltage signal;

a bandpass filter for extracting an ac component with a specified frequency from the voltage signal produced by the current to voltage conversion circuit;

an ion current threshold detection circuit for detecting the ion current resulting from the voltage applied to the ignition plug by the detection voltage generation circuit and for producing an ion current detection signal when the detected ion current exceeds a predetermined threshold; and a filter characteristic control circuit for controlling the characteristic of the filter.

The filter characteristic control circuit suppresses the sensitivity of the filter for the ac signal with the specific frequency for a predetermined period of time right after the ion current threshold detection circuit sends an ion current detection signal. The filter characteristic control circuit, after the predetermined period of time, increases the sensitivity of the filter circuit for the ac signal with the specific frequency.

The aforementioned current to voltage conversion circuit may comprise a diode and an ion current detection circuit for detecting the ion current and may produce, by means of the logarithmic forward bias characteristic of the diode, a voltage signal which is proportional to the ac component of the ion current detected by the ion current detection circuit.

The aforementioned ion current detection portion desirably comprises a current mirror circuit.

The bandpass filter portion desirably comprises:

a non-inverting amplifier;

a notch filter circuit placed within the negative feedback loop of the non-inverting amplifier; and a buffer circuit for transmitting an output signal from the notch filter circuit portion back to the non-inverting amplifier.

It is desirable that the filter characteristic control circuit keep the attenuation of the notch filter circuit for the signal with the specific frequency low for a predetermined period of time right after the ion current threshold detection sends an ion current detection signal, and that the filter characteristic control, after the predetermined period of time, increase the attenuation of the notch filter circuit for the signal with the specific frequency.

The buffer circuit may include either a voltage follower formed with an operational amplifier or an impedance conversion circuit formed with a transistor circuit.

When the buffer circuit portion includes an impedance conversion circuit formed with a transistor circuit, it is desirable that the impedance conversion circuit includes an npn transistor at the input thereof.

In the above case it is desirable that the ion current detection device further comprise a compensation circuit for compensating the input bias current of the impedance conversion circuit.

BRIEF DESCRIPTION OF THE DRAWINGS

The present invention will become more fully understood from the detailed description given below and the accompanying drawings wherein:

FIG. 8 illustrates the frequency characteristic of the band-pass filter 23 when the base current of the npn transistor 86 shown in FIG. 4 is low;

FIGS. 9A to 9D are timing charts showing the operation of the ion current detection device 2 shown in FIG. 1 when there is no knocking taking place;

FIGS. 10A to 10D are timing charts showing the operation of the ion current detection device 2 shown in FIG. 1 when there is knocking taking place;

FIG. 11 illustrates the frequency characteristic of the band-pass filter 23;

DESCRIPTION OF PREFERRED EMBODIMENTS

The present invention will be described below with reference to the drawings.

Embodiment 1

Figure 1:
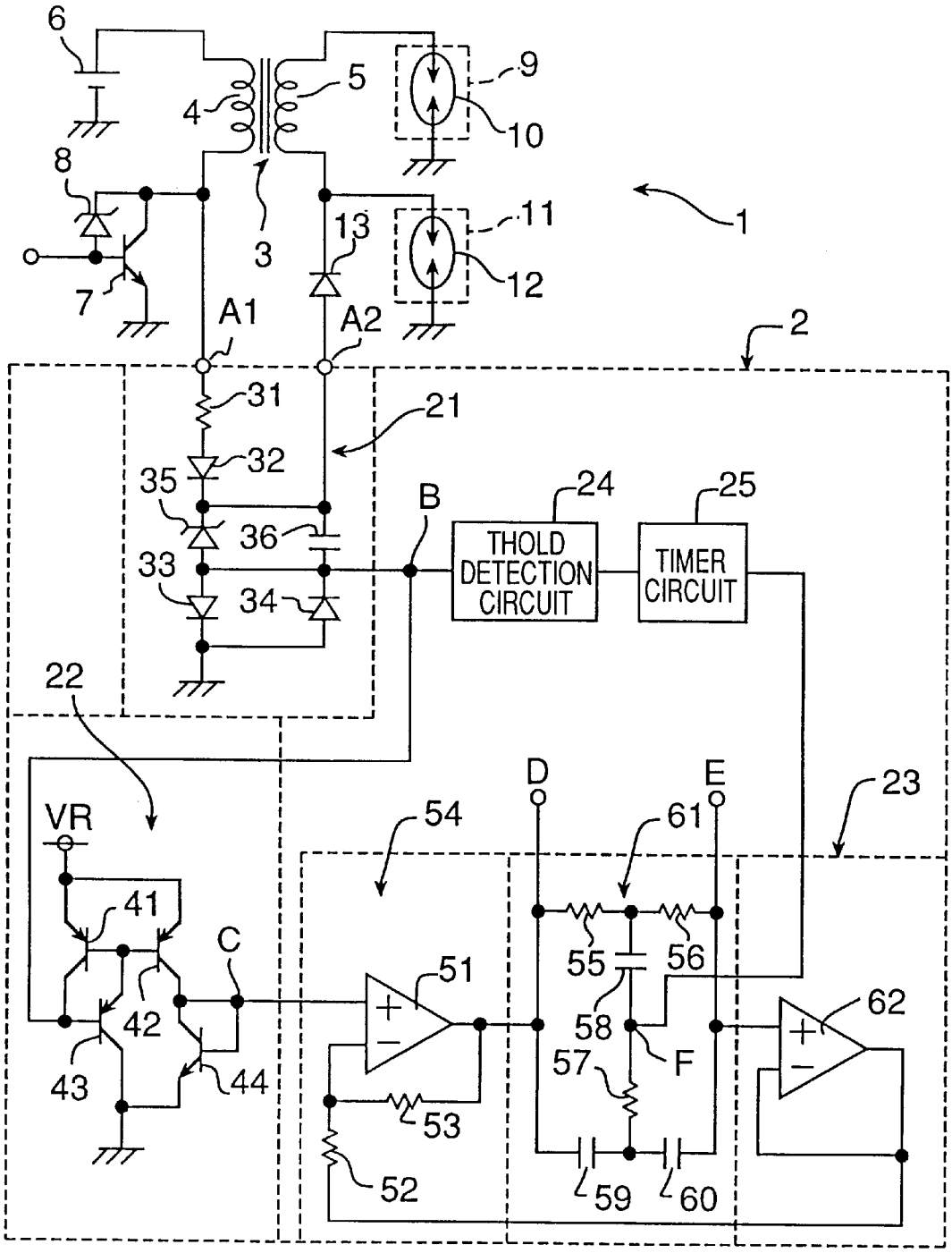
FIG. 1 shows a circuit diagram of the ion current detection device of Embodiment 1 of the present invention.

FIG. 1 illustrates a circuit diagram of the ion current detection device of Embodiment 1 of the present invention. Referring to FIG. 1 an ignition device 1 of the simultaneous firing type is connected to an ion current detection device 2 at the terminals A1 and A2. The ignition device 1 includes an ignition coil 3 having a primary coil 4 and a secondary coil 5. One end of the primary coil 4 is connected to the positive electrode of a battery 6 with the negative electrode of the battery 6 being grounded.

The other end of the primary coil 4 is connected to the collector of an npn transistor 7 for controlling the primary current of the ignition coil 3. The cathode of a Zener diode 8 limits the collector voltage of the npn transistor 7 or that of the terminal A1. The emitter of the npn transistor 7 is grounded. The base of the npn transistor 7 is connected to the anode of the Zener diode 8 and receives an ignition control signal provide by an ignition control computer unit (not shown). The Zener diode 8 limits the collector voltage of the npn transistor 7 to no more than about 300 V due to the counter electromotive force induced when the primary current of the ignition coil 3 is shut down.

One end of the secondary coil 5 of the ignition coil 3 is connected to an ignition plug 10 placed inside a cylinder 9, the ignition plug 10 being grounded; and the other end of the secondary coil 5 is connected to an ignition plug 12 placed inside a cylinder 11, the ignition plug 12 being also grounded. The other end of the secondary coil 5 is also connected to the cathode of a diode 13, with the anode of the diode 13 being connected to the terminal A2. The diode 13 prevents the current, due to the high positive voltage at the ignition plug 12 induced at firing, from flowing into the ion current detection device 2 and has a reverse breakdown voltage of a few tens of kV.

The ion current detection device 2 comprises a detection voltage generation circuit 21, an ion current/voltage conversion circuit 22, a band-pass filter 23, an ion current threshold detection circuit 24, and a timer 25.

The detection voltage generation circuit 21 comprises a resistor 31, diodes 32–34, a Zener diode 35, and a capacitor 36. One end of the resistor 31 is connected to the terminal A1, and the other end of the resistor 31 is connected to the anode of the diode 32. The cathode of the diode 32 is connected to both the cathode of the Zener diode 35 and one end of the capacitor 36 as well as to the terminal A2. The anode of the Zener diode 35, the other end of the capacitor 36, the anode of the diode 33, and the cathode of the diode 34 are connected together. The point at which those elements are connected is denoted as B. The connection point B is connected to both the ion current/voltage conversion circuit 22 and the ion current threshold detection circuit 24.

A high positive voltage (300–400 V) is generated at the terminal A1 when a counter electromotive force is induced at the primary coil 4 of the ignition coil 3 as the primary current of the ignition coil 3 is rapidly shut down by the npn transistor 7. If the capacitor 36 has no stored charge, the capacitor is charged by the current flowing from the battery 6 to the ground through the primary coil 4, the resistor 31, the diode 32, the capacitor 36, and the diode 33. As the capacitor 36 is charged, the voltage difference between the two terminals of the capacitor rises and reaches the Zener voltage. Then the current starts to detour from the battery 6 to the ground through the primary coil 4, the resistor 31, the diode 32, the Zener diode 35, and the diode 33.

A high voltage, proportional to the ratio of the numbers of turns of the secondary coil 5 and the primary coil 4, is generated on the secondary coil 5 of the ignition coil 3. The voltage between the two ends of the secondary coil 5 is typically a few tens of kV. While the two ends of the secondary coil 5 are at high voltages, there is no current through the diode 13 because its cathode voltage is higher than that of the anode. The voltage of the anode of the diode 13 is the charging voltage for the capacitor 36 which is in a range of 100 V. Therefore, as the voltage of the secondary coil 5 decreases the diode 13 becomes biased in the forward direction and the ion current starts to flow.

The ion current/voltage conversion circuit 22 comprises pnp transistors 41–43 and an npn transistor 44. The pnp transistors 41–43 form a current mirror circuit: the bases of the pnp transistors 41 and 42 are connected together and also connected to the emitter of the pnp transistor 43. The emitters of the pnp transistors 41 and 42 are connected together to the power terminal VR. The collector of the pnp transistor 41 is connected to the base of the pnp transistor 43 which is, in turn, connected to the connection point B of the detection voltage generation circuit 21.

The collector of the pnp transistor 42 is connected to the collector of the npn transistor 44 and the base of the npn transistor 44 is also connected to the collector of the npn transistor 44. This connection point is denoted as C as shown in FIG. 1. The collector of the pnp transistor 43 and the emitter of the npn transistor 44 are grounded. The pnp transistors 41–43 constitute an ion current detection portion and the npn transistor 44 functions as a diode.

The ion current/voltage conversion circuit 22 detects the ion current and converts the detected ion current signal into a voltage signal. The voltage terminal VR in the ion current/voltage conversion circuit 22 is supplied with a voltage, for example 1.4 V, such that the voltage of the collector of the pnp transistor 41 or that of the base of the pnp transistor 43 is 0 V. This configuration allows the ion current to flow through the collector of the pnp transistor 41, the capacitor 36, and the diode 13 to the ignition plugs 10 and 12. Accordingly a current proportional to the ion current flows into the collector of the npn transistor 44 due to the current mirror circuit including the pnp transistors 41–43. The ion current is converted to the base voltage of the npn transistor 44.

The base voltage VB44 of the npn transistor 44 is given by Eq. (1).

$$VB44=\{k\times T\times ln(IC44)\}/e \quad (1)$$

where IC44 is the collector current of the npn transistor 44; k, the Boltzman's constant; e, the electron charge; and T, the absolute temperature.

Therefore, a variation of the base voltage VB44, ΔVB44, is given by Eq. (2) as a function of a variation of the ion current associated with knocking or a variation of the collector current of the npn transistor 44, ΔIC44.

$$\Delta VB44=\{k\times T\times ln(IC44+\Delta IC44)\}/e-\{k\times T\times ln(IC44)\}/e=k\times T\ ln\{(IC44+\Delta IC44)/IC44\}/e \quad (2)$$

Eq. (2) indicates that, if the temperature is constant, the variation of the ion current due to the knocking relative to the total ion current should be the same as the variation in the base voltage at the npn transistor 44.

The band-pass filter 23 comprises a non-inverting amplifier circuit 54 including an operational amplifier 51 and two resistors 52 and 53, a notch filter 61 including resistors 55–57 and capacitors 58–60, and an operational amplifier 62 configured as the voltage follower. The non-inverting input terminal of the operational amplifier 51 of the band-pass filter 23 is coupled to the connection point C of the ion current/voltage conversion circuit 22; the inverting input terminal of the operational amplifier 51 is connected to the output terminal through the resistor 53; and the non-inverting input terminal of the operational amplifier 51 is connected to the output of the operational amplifier 62 via the resistor 52.

The resistor 55 and the capacitor 59 of the notch filter 61 are connected to the output terminal of the operational amplifier 51. The point at which the resistor 55 and capacitor 59 are connected serves as an output terminal of the band-pass filter 23 and is denoted as D. The other end of the resistor 55 is coupled with one end of the resistor 56 and one end of the capacitor 58. The other end of the capacitor 59 is coupled with one end of the resistor 57 and one end of the capacitor 60; the other end of the resistor 56 and the other end of the capacitor 60 are connected together and both are further connected to the non-inverting input terminal of the operational amplifier 62. The point at which the resistor 56 and the capacitor 60 are connected serves as another output terminal of the band-pass filter 23 and is denoted as E. The other end of the capacitor 58 and the other end of the resistor 57 are connected together and both are further connected to the timer 25. The point at which the resistor 57 and the capacitor 58 are connected is denoted as F as shown in FIG. 1. The inverting input terminal of the operational amplifier 62 is coupled with its output terminal.

Figure 2:
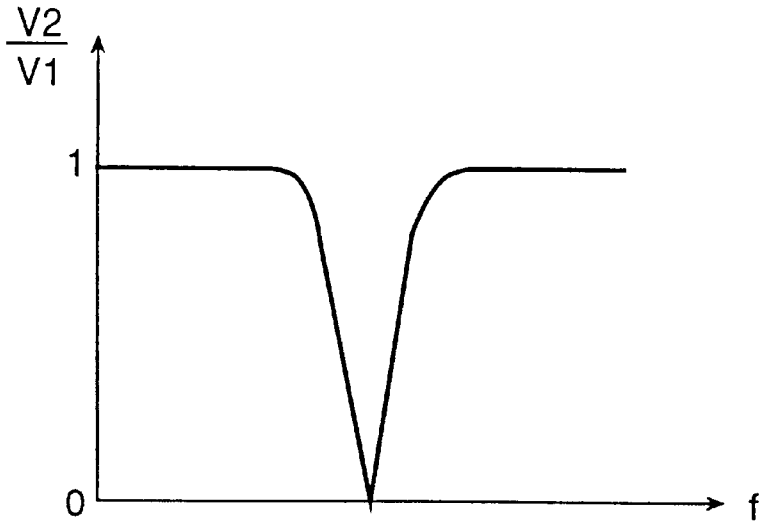
FIG. 2 shows the frequency characteristic of the notch filter 61.

The frequency characteristic of the notch filter 61, when the connection point F is grounded, is shown in FIG. 2, where V1 is the voltage at the output terminal D and V2 is the voltage at the output terminal E. As shown in FIG. 2, the notch filter 61 shuts off at a specific frequency. Therefore, a notch filter inserted in a negative feedback loop, as in the case of the band-pass filter 23, provides much less negative feedback for the specific shut-off frequency compared with other frequencies. Consequently, the signal having the specific shut-off frequency appears at the feedback point as a voltage variation. Thus, the band-pass filter 23 has a characteristic opposite to that of the notch filter.

The ion current threshold detection circuit 24 compares the ion current with a predetermined threshold current value, determines whether the ion current is greater than the threshold, and sends the decision signal to the timer 25.

Figure 3:
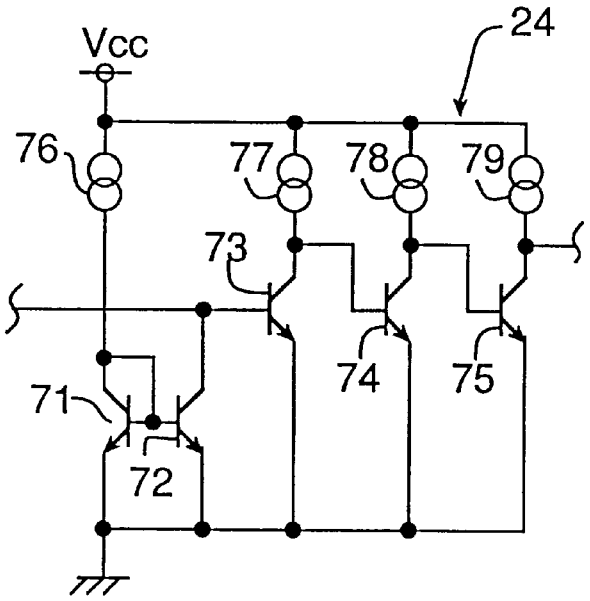
FIG. 3 is a circuit diagram of the ion current threshold detection circuit 24.

FIG. 3 illustrates a circuit diagram of the ion current threshold detection circuit 24. Referring to FIG. 3, the ion current threshold detection circuit 24 comprises npn transistors 71–75 and constant-current sources 76–79. The npn transistors 71 and 72 form a current mirror circuit.

The emitters of the npn transistors 71 and 72 are grounded. The collector of the npn transistor 71 is connected to the power supply terminal VCC through the constant-current source 76. The bases of the npn transistors 71 and 72 are coupled together and connected to the collector of the npn transistor 71. The collector of the npn transistor 72 is connected to the connection point B of the detection voltage generation circuit 21 and also to the base of the npn transistor 73. The emitter of the npn transistor 73 is grounded. The collector of the npn transistor 73 is connected to the power supply terminal VCC through the constant-current source 77 and also to the base of the npn transistor 74.

The emitter of the npn transistor 74 is grounded. The collector of the npn transistor 74 is connected to the power supply terminal VCC through the constant-current source 78 and also to the base of the npn transistor 75. The emitter of the npn transistor 75 is grounded. The collector of the npn transistor 75 is connected to the power supply terminal VCC through the constant-current source 79 and also to the timer 25.

The ion current flowing through the connection point B of the detection voltage generation circuit 21 also flows through the base of the npn transistor 73. If the base current of the npn transistor 73 is larger than the current flowing through the current mirror circuit formed with the npn transistors 71 and 72, the npn transistor 73 is turned on, which causes the npn transistor 74 to be turned off and the npn transistor 75 to be turned on. Accordingly, the npn transistor 75 outputs an "L" level signal or the ion current signal to the timer 25. If the base current of the npn transistor 73 is smaller than the current flowing through the current mirror circuit formed with the npn transistors 71 and 72, the npn transistor 73 is turned off, which causes the npn transistor 74 to be turned on and the npn transistor 75 to be turned off. Accordingly, the npn transistor 75 outputs an "H" level signal.

The timer 25 delays the "L" level signal for a predetermined period of time. As mentioned above the "L" level signal indicates that the ion current signal from the ion current threshold detection circuit 24 is larger than the predetermined threshold current.

Figure 4:
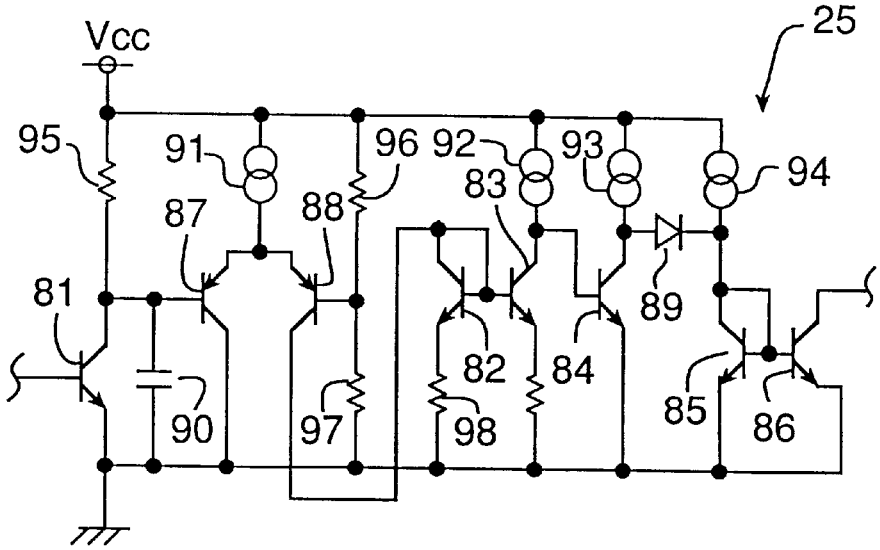
FIG. 4 shows a circuit diagram of the timer 25 shown in FIG. 1.

FIG. 4 is a circuit diagram of the timer 25. Referring to FIG. 4, the timer 25 comprises npn transistors 81–86, pnp transistors 87 and 88, a diode 89, a capacitor 90, constant-current source 91–94, and resistors 95–98. The npn transistors 82, 83, and a resistor 98 form a leakcut circuit which prevents the timer from operating with a small current; the npn transistors 85 and 86 form a current mirror circuit; and the pnp transistors 87 and 88 and the constant current source 91 form a differential amplifier.

The emitters of the pnp transistors 87 and 88 are coupled together and connected to the power supply terminal VCC through the constant-current source 91. The collector of the pnp transistor 87 is grounded. The base of the pnp transistor 87 is connected to the collector of the npn transistor 81 and also to the capacitor 90 which, in turn, is grounded. The emitter of the npn transistor 81 is grounded; the collector thereof is connected to the power supply terminal VCC through the resistor 95; and the base is connected to the connection point between the collector of the npn transistor 75 and the constant-current source 79 of the ion current threshold detection circuit 24. The resistors 96 and 97 are connected in series with one end of the resistor 96 connected to the power supply terminal VCC and with one end of the resistor 97 grounded. The point at which the resistors 96 and 97 are connected is connected to the base of the pnp transistor 88 and provides a reference voltage for the differential amplifier.

The bases of the npn transistors 82 and 83 are coupled and connected to the collector of the pnp transistor 88 and also to the collector of the npn transistor 82. The emitter of the npn transistor 82 is grounded through the resistor 98 and the emitter of the npn transistor 83 is directly grounded. The collector of the npn transistor 83 is connected to the power supply terminal VCC through the constant-current source 92. It is also connected to the base of the npn transistor 84. The emitter of the npn transistor 84 is grounded while the collector of the npn transistor 84 is connected to the power supply terminal VCC through the constant-current source 93 and also to the anode of the diode 89.

The bases of the npn transistors 85 and 86 are coupled together and connected to the collector of the npn transistor 85. The collector of the npn transistor 85 is connected to the power supply terminal VCC through the constant-current source 94 and also to the cathode of the diode 89. Both the emitters of the npn transistors 85 and 86 are grounded. The collector of the npn transistor 86 is connected to the connection point F of the band-pass filter 23.

When an ion current signal or an "L" level signal from the ion current threshold detection circuit 24 is received at the base of the npn transistor 81, the npn transistor 81 is turned off and the capacitor 90 is charged through the resistor 95. As the capacitor 90 is being charged, the base voltage of the pnp transistor 87 rises. When the base voltage of the pnp transistor 87 exceeds the base voltage of the pnp transistor 88, the collector current of the pnp transistor 88 increases causing the npn transistor 83 to be turned on and the npn transistor 84 to be turned off. Then a current flows through the base of the npn transistor 86 from the constant-current source 93 and 94.

In summary, when the timer 25 receives an "L" level signal from the ion current threshold detection circuit 24, a base current of the npn transistor 86 starts to flow through the constant-current source 93 and 94 only after a time delay which is determined by the time it takes for the base voltage of the pnp transistor 87 to reach to the predetermined base voltage of the pnp transistor 88 as the capacitor is charged. The delay time of the timer 25 is determined by the capacitance of the capacitor 90, the resistance of the resistor 95, and the base voltage of the pnp transistor 88.

When a "H" level signal is sent from the ion current threshold detection circuit 24 to the timer 25, the npn transistor 81 is turned on and the capacitor 90 discharges through the npn transistor 81 pulling down the base voltage of the pnp transistor 87. When the base voltage of the pnp transistor 87 decreases below the base voltage of the pnp transistor 88, the collector current of the pnp transistor 88 decreases causing the npn transistor 83 to be turned off and the npn transistor 84 to be turned on. Then a current through the base of the npn transistor 86 flows only from the constant-current source 94. Thus the timer 25 changes the base current of the npn transistor 86 depending on the signal level of the ion current threshold detection circuit 24 and the saturation voltage of the npn transistor 86.

The constant-current source 93 is designed to supply a larger current than the constant-current source 94. For example, the constant-current source 93 may provide 200 $\mu$A while the constant-current source 94 may provide 6 $\mu$A. That is, the timer 25 changes the base current of the npn transistor 86 from 6 $\mu$A to 206 $\mu$A at the predetermined delayed time after it receives an ion current signal or an "L" level signal from the ion current threshold detection circuit 24. On the other hand, if the timer 25 receives a "H" level signal from the ion current threshold detection circuit 24, the timer 25 changes the base current of the npn transistor 86 from 206 $\mu$A to 6 $\mu$A.

Figure 5:
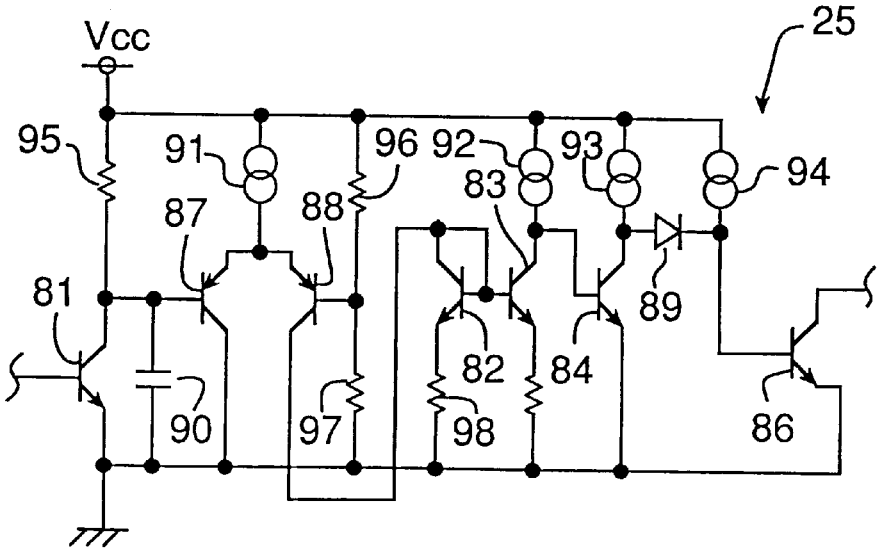
FIG. 5 shows another circuit diagram of the timer 25 shown in FIG. 1.

FIG. 5 illustrates another circuit of the timer 25, which may also be used replacing the circuit shown in FIG. 4. The difference between the two figures is that the npn transistor 86 is removed in FIG. 5. The base of the npn transistor 86 is connected to the power supply terminal VCC through the constant-current source 94 and also to the cathode of the diode 89.

Figure 6:
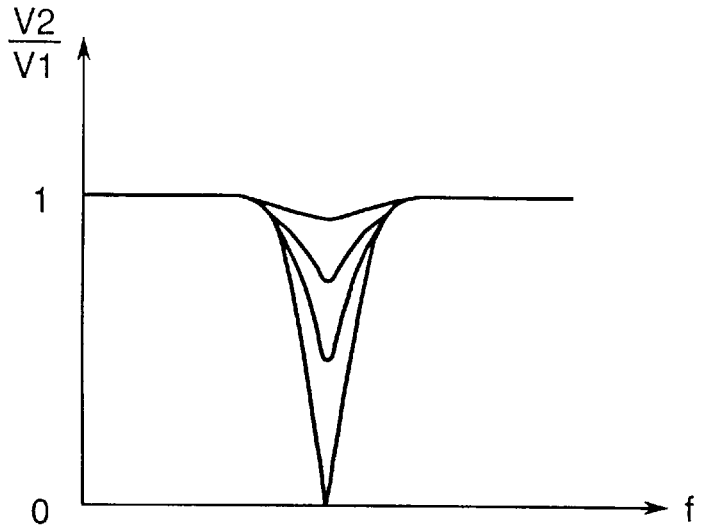
FIG. 6 shows the change in frequency characteristic of the notch filter 61 corresponding to the change in the base current of the npn transistor 86 shown in FIG. 4.

Next, the effect of the change of the base current of the npn transistor 86 on the frequency characteristic of the notch filter 61 of the band-pass filter 23 will be described. FIG. 6 shows a change in the frequency characteristic of the notch filter 61 corresponding to the change in the base current of the npn transistor 86. FIG. 6 shows that as the base current of the npn transistor 86 decreases the degree of shut-off of the notch filter 61 at the specific frequency also decreases, and, conversely, that as the base current of the npn transistor 86 increases the degree of shut-off at the specific frequency also increases. The notch filter 61 exhibits the maximal shut-off for the specific frequency when the connection point F is grounded.

Figure 7:
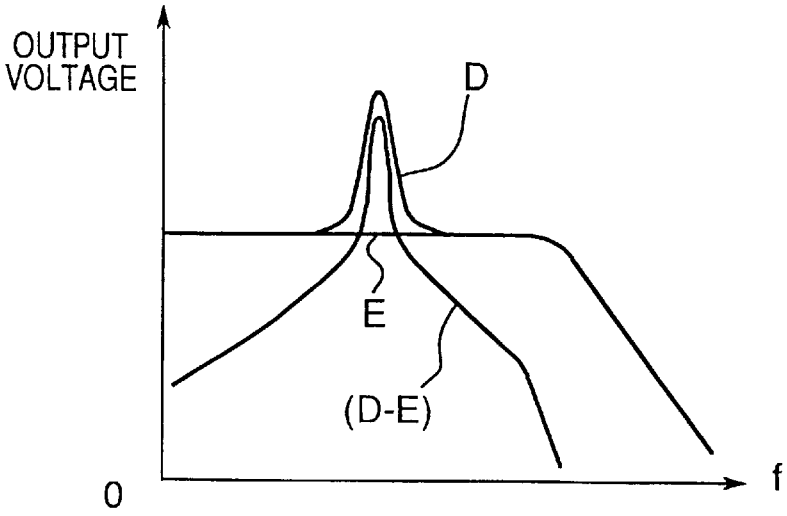
FIG. 7 illustrates the frequency characteristic of the band-pass filter 23 when the base current of the npn transistor 86 shown in FIG. 4 is high.

FIG. 7 illustrates the frequency characteristic of the output signals at the output terminals D and E of the band-pass filter 23 when the base current of the npn transistor 86 of the timer 25 is large. FIG. 8 illustrates the frequency characteristic of the output signals at the output terminals D and E of the band-pass filter 23 when the base current of the npn transistor 86 of the timer 25 is small. The curves denoted as (D-E) in FIGS. 7 and 8 show the frequency characteristics of the difference signals between the output terminals D and E. As shown in FIGS. 7 and 8 the larger base current of the npn transistor 86 of the timer 25 gives rise to the sharper frequency characteristics of the band-pass filter 23.

Thus, when the ion current threshold detection circuit 24 detects an ion current larger than the threshold current, it sends the ion current detection signal to the timer 25. The timer 25, in turn, increases the degree of shut-off of the notch filter 61 of the band-pass filter 23 at the specific frequency at the predetermined delayed time.

In other words, while the ion current rapidly varies immediately after the ignition, the base current of the npn transistor 86 is kept at 6 $\mu$A so that the notch filter 61 has a slow shut-off characteristic for the specific frequency giving rise to a low Q-value of the band-pass filter 23 which reduces the duration when the ringing occurs. Then, after an appropriate delay time, the base current of the npn transistor 86 jumps to 206 μA causing the notch filter 61 to have a sharp shut-off characteristic for the specific frequency which increases the Q-value of the band-pass filter 23 resulting in a sufficiently high sensitivity in detecting the knocking signal.

FIG. 9 illustrates a timing chart showing the operation of the ion current detection device 2 when there is no knocking taking place while FIG. 10 is a timing chart when there is knocking taking place.

FIG. 9A and FIG. 10A show the voltage variations at the connection point C caused by the ion current; FIG. 9B and FIG. 10B show the base currents of the npn transistor 86 of the timer 25; FIG. 9C and FIG. 10C show the output signal between the terminals D and E of the notch filter 61; and FIG. 9D and FIG. 10D show the output signals between the terminals D and E of the notch filter 61 when the base current of the npn transistor 86 is kept high.

FIGS. 9 and 10 show that the base current of the npn transistor 86 of the timer 25 remains low at 6 μA immediately after the ion current starts to flow or right after the voltage at the connection point C rapidly increases but that the base current then increases to 206 μA after a predetermined delay time. This shortens the duration of the ringing and allows the knocking signal to appear clearly in the signal (D-E) obtained between the points D and E of the notch filter 61. It should be noted that if the base current of the npn transistor 86 is kept at 206 μA at all times, the ringing lasts for a long time and makes it impossible to distinguish the knocking signal from the ringing.

In summarizing the foregoing, the ion current detection device suppresses the ion current signal for a predetermined period of time, e.g. 500 μsec, after the ion current starts to flow when the mixed gases are ignited. Since the switching of the filter characteristic gives rise to some degree of ringing, it is desirable to start the detection of the knocking sometime after the characteristic of the band-pass filter 23 is changed. For example, the Q-value of the band-pass filter 23 may be kept low to make the filter characteristic slow for 350 μsec after the ion current is generated; then the Q-value of the band-pass filter 23 may be increased at 350 μsec after the ion current is generated; and the detection of the knocking signal may start at 500 μsec after the ion current is generated.

The center frequency of the pass band of the band-pass filter 23 of the ion current detection device 2 shifts toward the lower frequency side, as shown in FIG. 11, when the base current of the npn transistor 86 is decreased. A circuit for preventing this frequency shift is shown in FIG. 12.

Figure 12:
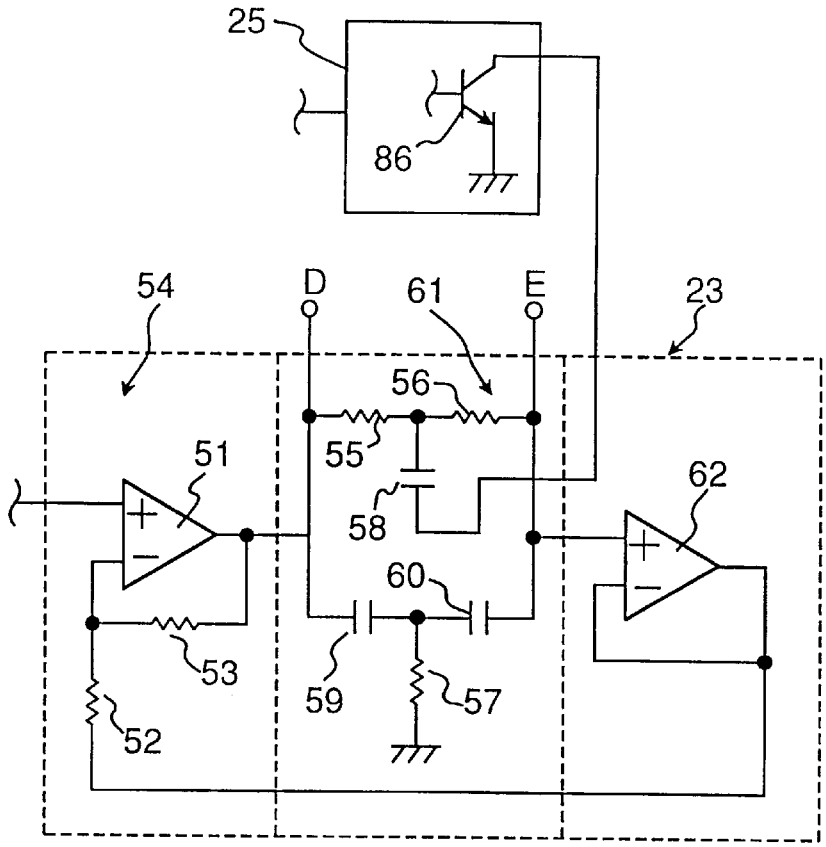
FIG. 12 is a circuit diagram of part of another ion current detection device of Embodiment 1 of the present invention.

Referring to FIG. 12, one end of the capacitor 58 of the notch filter 61 is connected to the point at which the resistors 55 and 56 are connected, and the other end of the capacitor 58 is connected to the collector of the npn transistor 86. The resistor 57 of the notch filter 61 is connected to the point at which the capacitors 59 and 60 are connected, and the other end of the resistor is grounded.

Figure 13:
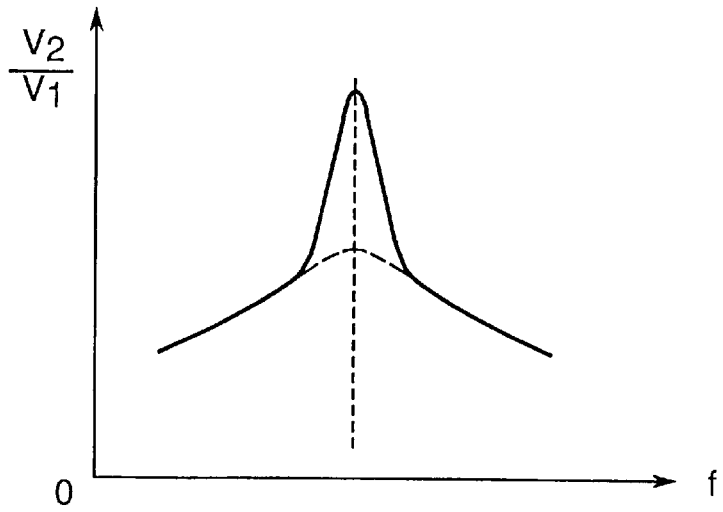
FIG. 13 shows the frequency characteristic of the band-pass filter shown in FIG. 12.

This configuration for the band-pass filter 23 will produce a frequency characteristic as shown in FIG. 13, which exhibits no shift of the center frequency of the pass band when the base current of the npn transistor 86 is changed.

According to the ion current detection device of Embodiment 1 of the present invention, the ion current threshold detection circuit 24 sends a signal, referred to as the ion current detection signal, to the timer 25 when the ion current threshold detection circuit detects an ion current larger than a predetermined threshold current, and then the timer 25, at a predetermined delay time after receiving the ion current detection signal, sharpens the shut-off characteristic of the notch filter 61 of the band pass filter 23 for the specific frequency. This scheme reduces the possibility of any false detection of the knocking state due to the ringing using a simplified circuit, resulting in a smaller detection device at a reduced manufacturing cost. This scheme also improves the conflicting requirements of the suppression of the ringing and the enhancement of the detection sensitivity of the knocking current and allows for the detection of the knocking within a short time after the ion current is generated.

Embodiment 2

Embodiment 1 includes a buffer circuit using a voltage follower formed with the operational amplifier 62 as a means for impedance conversion for the voltage at the output terminal E of the band-pass filter 23. The buffer circuit, however, can be formed with a transistor circuit for the same purpose. The embodiment of the ion current detection device including a buffer circuit formed with a transistor circuit is referred to as Embodiment 2.

Figure 14:
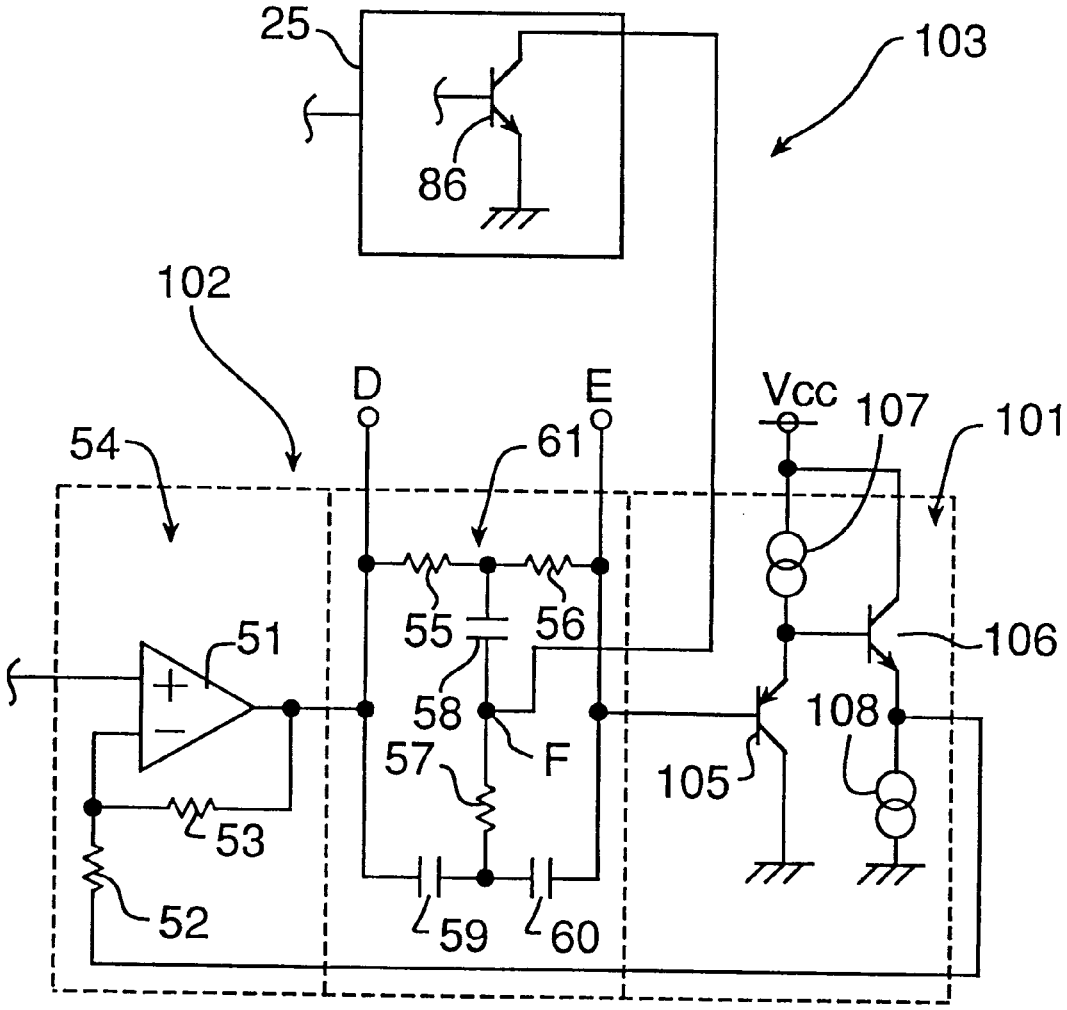
FIG. 14 shows a circuit diagram of part of the ion current detection device of Embodiment 2 of the present invention.

FIG. 14 illustrates a circuit diagram of part of the ion current detection device of Embodiment 2 of the present invention. The like reference numerals of FIGS. 14 and 1 indicate identical or functionally similar elements. Thus explanation of those elements will not be repeated. FIG. 14 only shows the portion of the circuit which is different from FIG. 1 and only the differences with FIG. 1 will be described below.

The difference between FIG. 14 and FIG. 1 is that the operational amplifier 62 of the band-pass filter 23 in FIG. 1 is replaced by an impedance conversion circuit 101 in FIG. 14. Accordingly, the band-pass filter in FIG. 14 is referred to as the band-pass filter 102, and the ion current detection device of Embodiment 2 is referred to as the ion current detection device 103.

Referring to FIG. 14, the impedance conversion circuit 101 comprises a pnp transistor 105, an npn transistor 106, and two constant-current sources 107 and 108. The base of the pnp transistor 105 is connected to the point at which the capacitor 60 and the resistor 56 of the notch filter 61 are connected. The collector of the pnp transistor 105 is grounded. The emitter of the pnp transistor 105 is connected to the power supply terminal VCC through the constant-current source 107. The base of the npn transistor 106 is connected to the point at which the emitter of the pnp transistor 105 and the constant-current source 107 are connected; the collector of the npn transistor 106 is connected to the power supply terminal VCC; and the emitter thereof is grounded through the constant-current source 108. The emitter of the npn transistor 106 is also connected to the inverting input terminal of the operational amplifier 51 through the resistor 52.

The impedance conversion circuit 101, with the above configuration, operates in the same manner as the buffer circuit in FIG. 1 using a voltage follower formed with the operational amplifier 62 but produces a larger offset voltage between the input and output. It should be noted that the larger offset voltage will not cause any problem in the ion current detection device 103 of the present embodiment. If the operational amplifier 62 in FIG. 1 has a narrow band width, the high gain of the voltage amplification stage of the operational amplifier 51 delays the phase of the feedback circuit and makes the circuit easy to oscillate at high frequencies. The impedance conversion circuit 101, however, can maintain a good high frequency characteristic and suppresses the oscillation at high frequencies.

The ion current detection device of Embodiment 2 of the present invention utilizes an impedance conversion circuit formed with a transistor circuit which replaces the impedance conversion circuit shown in FIG. 1 formed with the operational amplifier 62. This modification not only provides the same functions as Embodiment 1 but also reduces the possibility of oscillation with a rather simple circuit.

Embodiment 3

The impedance conversion circuit 101 of Embodiment 2 may be formed with an npn transistor at its input and a pnp transistor at its output. Embodiment 3 is the ion current detection device with this modified impedance conversion circuit.

Figure 15:
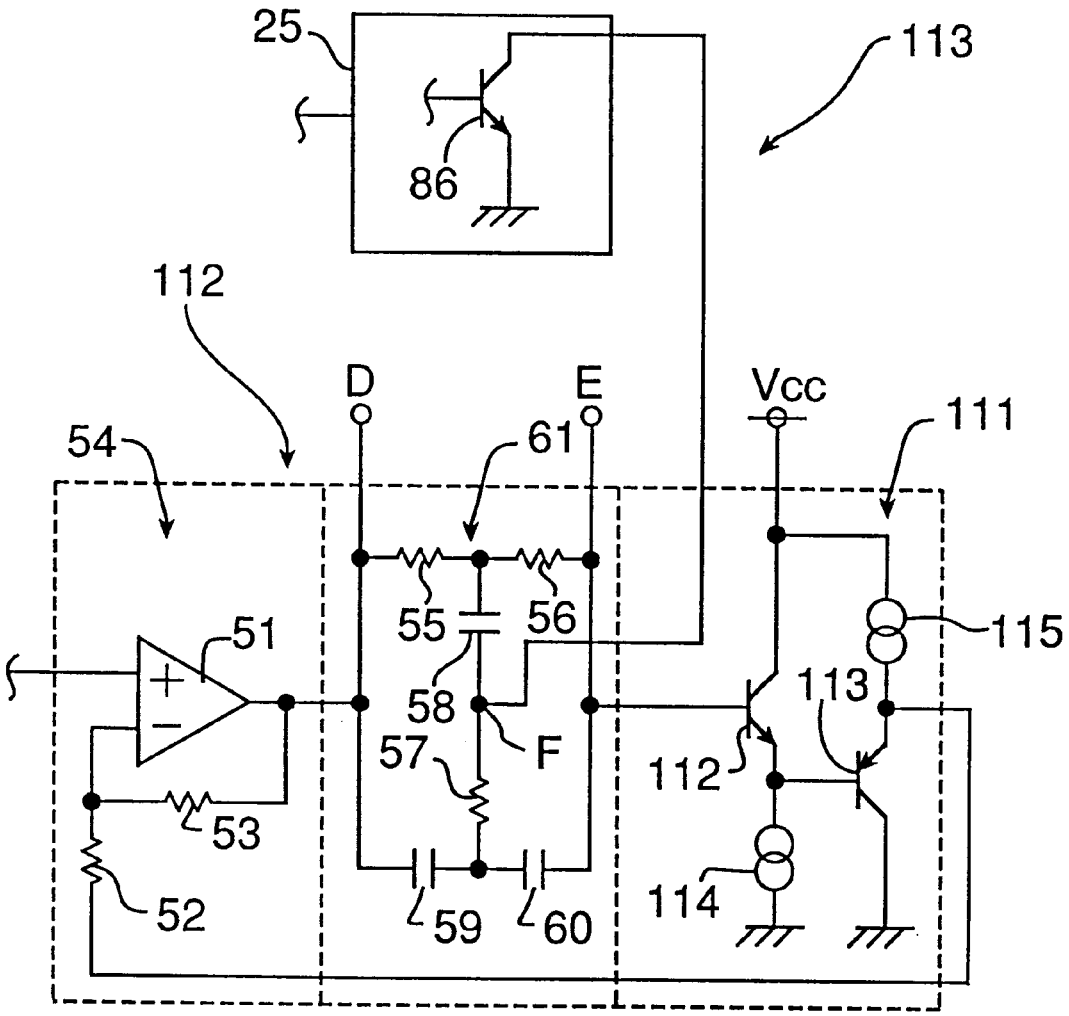
FIG. 15 shows a circuit diagram of part of the ion current detection device of Embodiment 3 of the present invention.

FIG. 15 illustrates a circuit diagram of part of the ion current detection device of Embodiment 3 of the present invention. The like reference numerals of FIGS. 15 and 14 indicate identical or functionally similar elements. Thus explanation of those elements will not be repeated and only the difference between FIG. 15 and FIG. 14 will be described below.

The difference between FIG. 15 and FIG. 14 is that the impedance conversion circuit 101 in FIG. 14 is replaced with an impedance conversion circuit 111. In reflecting this change the band-pass filter of Embodiment 3, corresponding to the band-pass filter 102 in FIG. 14, is referred to as the band-pass filter 112, and the ion current detection device of Embodiment 3, corresponding to the ion current detection device in FIG. 14, is referred to as the ion current detection device 113.

The impedance conversion circuit 111 comprises an npn transistor 112, a pnp transistor 113, and two constant-current sources 114 and 115. The base of the npn transistor 112 is connected to the point at which the resistor 56 and the capacitor 60 of the notch filter 61 are connected. The collector of the npn transistor 112 is connected to the power supply terminal VCC. The emitter of the npn transistor 112 is grounded through the constant-current source 114. The base of the pnp transistor 113 is connected to the point at which the emitter of the npn transistor 112 and the constant-current source 114 are connected; the collector of the pnp transistor 113 is grounded; and the emitter thereof is connected to the power supply terminal VCC through the constant-current source 115. The emitter of the pnp transistor 113 is also connected to the inverting input terminal of the operational amplifier 51 through the resistor 52.

The impedance conversion circuit 111, with the above configuration, operates in the same manner as the buffer circuit in FIG. 1 using a voltage follower formed with the operational amplifier 62 but produces a larger offset voltage between the input and output. It should be noted that the larger offset voltage will not cause any problem in the application to the ion current detection device 113 of the present embodiment. If the operational amplifier 62 in FIG. 1 has a narrow band width, the high gain of the voltage amplification stage of the operational amplifier 51 delays the phase of the feedback circuit and makes the circuit easy to oscillate at high frequencies. The impedance conversion circuit 111, however, can maintain a good high frequency characteristic and suppresses the oscillation at high frequencies.

Reduction of the capacitances of the capacitors used in the notch filter 61 in order to decrease the cost requires higher resistances of the resistors 55–57. The higher resistances of the resistors 55 and 56 generate a voltage between the input and output terminals of the notch filter 61, that is, between the output terminals D and E, due to the input bias current needed for the impedance conversion circuit forming a buffer circuit. The band-pass filter 111 obtains an appropriate filter characteristic by detecting the voltages of the input and output terminals of the notch filter 61. Therefore, the larger voltage difference between the two terminals of the notch filter 61 complicates the post stage circuits. Typically the voltage difference between the input and output terminals of the notch filter 61 is designed to be minimal in order to obtain a large gain in the post stage.

Reducing the input bias current of the impedance conversion circuit decreases the voltage difference between the input and output terminals of the notch filter 61. Typically, in semiconductor integrated circuits, npn transistors have better current amplification performance than pnp transistors. Therefore, employing of an npn transistor 112 at the input of the impedance conversion circuit 111 allows for reduction of the input bias current.

The ion current detection device of Embodiment 3 of the present invention includes an impedance conversion circuit formed with a transistor circuit replacing the impedance conversion circuit formed with the operational amplifier 62 shown in FIG. 1. This transistor circuit for the impedance conversion circuit employs an npn transistor at the input and a pnp transistor at the output, thus providing the same functions as Embodiment 2, reducing the voltage difference between the input and output terminals of the notch filter, and hence enabling capacitors of lower capacitances to be used in the notch filter, thus resulting in a cost reduction of the ion current detection device.

Embodiment 4

Embodiment 3 includes an impedance conversion circuit which has an npn transistor at its input in order to reduce the input bias current of the buffer circuit formed with the impedance conversion circuit. There are, however, cases in which an npn transistor cannot not be allowed to be used at the input of the impedance conversion circuit due to a limit imposed on the circuit. In this case a pnp transistor may be used at the input of the impedance conversion circuit, and a circuit for reducing the input bias current of the impedance conversion circuit may be added to the band-pass filter. The ion current detection device having this configuration is referred to as Embodiment 4.

Figure 16:
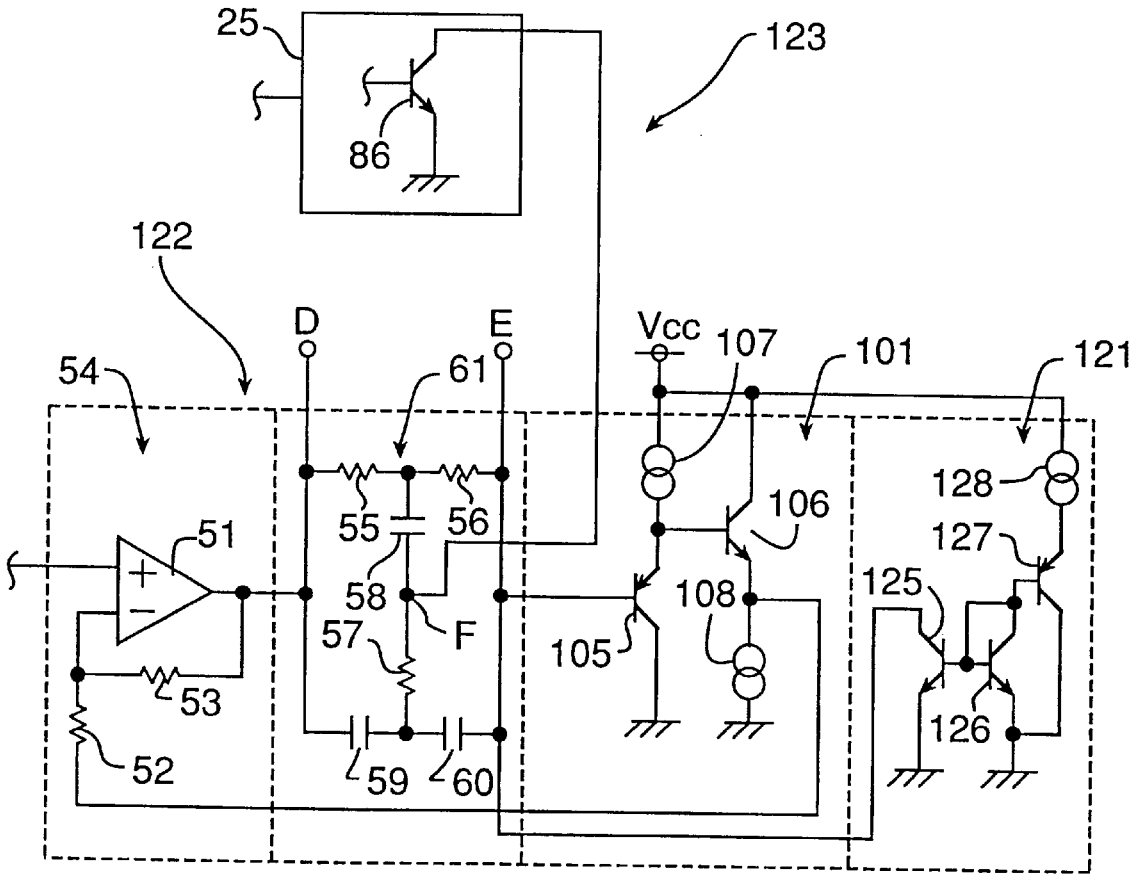
FIG. 16 shows a circuit diagram of part of the ion current detection device of Embodiment 4 of the present invention.

FIG. 16 illustrates a circuit diagram of part of the ion current detection device of Embodiment 4 of the present invention. The like reference numerals of FIGS. 16 and 14 indicate identical or functionally similar elements. Thus an explanation of those elements will not be repeated and only the differences with FIG. 14 will be described below.

FIG. 16 differs from FIG. 14 in that FIG. 16 includes a base current compensation circuit 121 functionally added to the band-pass filter 102 of FIG. 14 for compensating the base current of the pnp transistor 105 of the impedance conversion circuit 101. In reflecting this change the band-pass filter of Embodiment 4, corresponding to the band-pass filter 102 in FIG. 14, is referred to as the band-pass filter 122, and the ion current detection device of Embodiment 4, corresponding to the ion current detection device 103 in FIG. 14, is referred to as the ion current detection device 123. The base current compensation circuit 121 is also referred to as the circuit compensation portion.

Referring to FIG. 16, the band-pass filter 122 comprises an non-inverting amplifier circuit 54, a notch filter 61, an impedance conversion circuit 101, and a base current compensation circuit 121. The base current compensation circuit 121 includes npn transistors 125 and 126, a pnp transistor 127, and a constant-current source 128, the npn transistors 125 and 126 forming a current mirror circuit.

The bases of the npn transistors 125 and 126 of the base current compensation circuit 121 are coupled together and connected to the collector of the npn transistor 126. The emitter of the npn transistor 125 is grounded and its collector is connected to the base of the pnp transistor 105 of the impedance conversion circuit 101. The emitter of the npn transistor 126 is also grounded, and its collector is connected to the base of the pnp transistor 127. The collector of the pnp transistor 127 is grounded, and its emitter is connected to the power supply voltage terminal VCC through the constant-current source 128.

In the above configuration the input bias current of the impedance conversion circuit 101 flows through the resistor 56 of the notch filter 61 from the base of the pnp transistor 105. The base current compensation circuit 121 can send the same amount of current through the npn transistor 125 to the ground to compensate for the input bias current of the impedance conversion circuit 101.

The ion current detection device of Embodiment 4 of the present invention includes the base current compensation circuit 121 which can draw a current of the same amount as the input bias current for the impedance conversion circuit 101 from the input of the impedance conversion circuit 101 to the ground. Therefore, the present embodiment can provide the same effects as Embodiment 3. Further, the pnp transistor used at the input of the impedance conversion circuit prevents the current which flows from the impedance conversion circuit to the notch filter from affecting the performance of the notch filter.

Embodiment 5

Embodiment 4 utilizes the same impedance conversion circuit as does Embodiment 2 which includes a pnp transistor at its input and an npn transistor at its output. Embodiment 4, however, includes a base current compensation circuit for the impedance conversion circuit. That is, Embodiment 4 is the same as Embodiment 2 except for having an additional operational base current compensation circuit for its impedance conversion circuit. The similar configuration may be applied to Embodiment 3 which includes a npn transistor at its input and a pnp transistor at its output. That is, an appropriate operational base current compensation circuit may be added to Embodiment 3. This configuration applied to Embodiment 3 is referred to as Embodiment 5.

Figure 17:
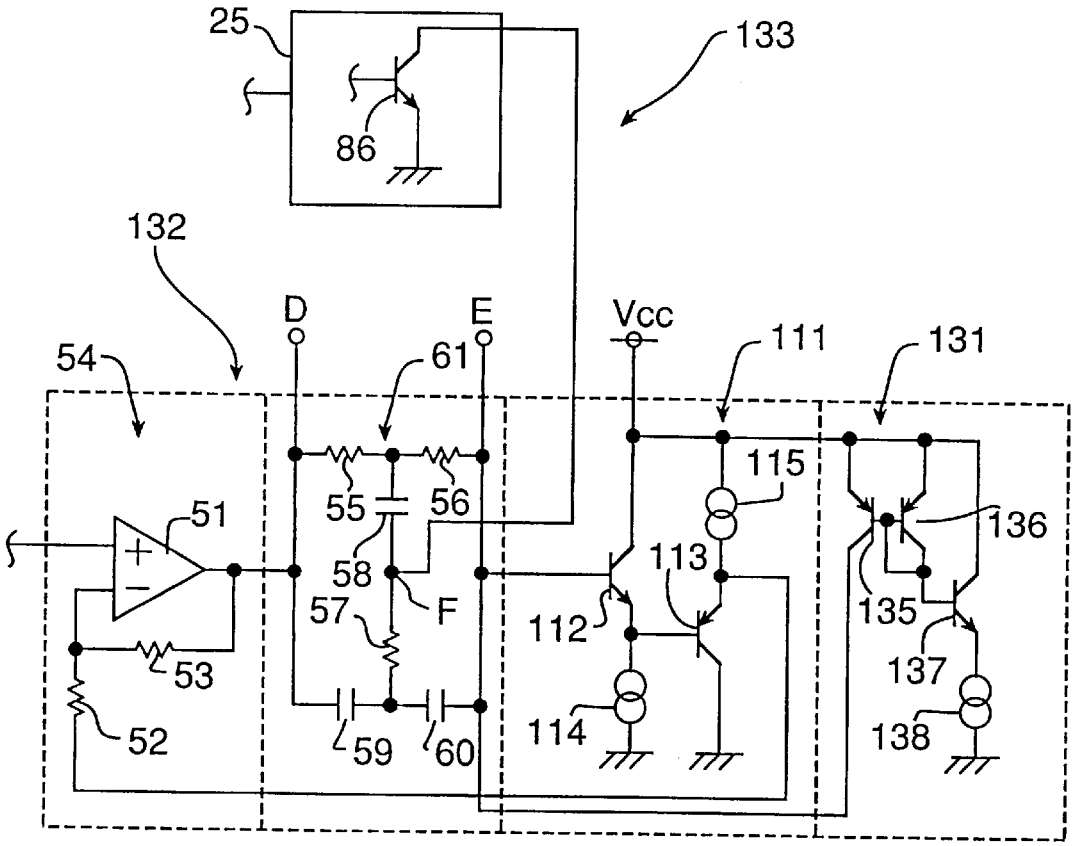
FIG. 17 shows a circuit diagram of part of the ion current detection device of Embodiment 5 of the present invention.
Figure 18:
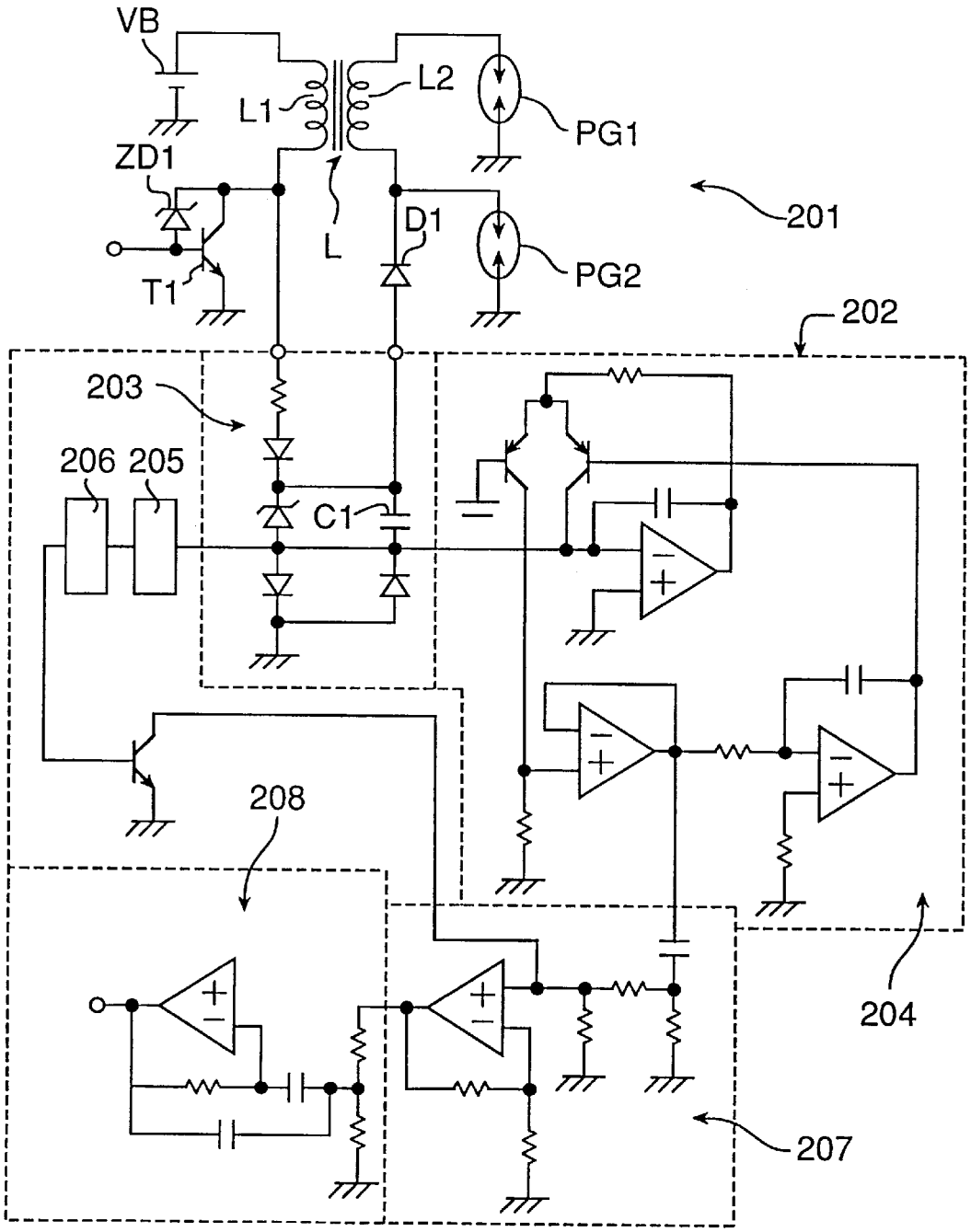
Fig.18 PRIOR ART
FIG. 18 shows a circuit diagram of the prior art ion current detection device.

FIG. 17 illustrates a circuit diagram of part of the ion current detection device of Embodiment 5 of the present invention. The like reference numerals of FIGS. 17 and 15 indicate identical or functionally similar elements. Thus explanation of those elements will not be repeated, and only the differences with FIG. 15 will be described below.

FIG. 17 differs from FIG. 15 in that FIG. 17 includes a base current compensation circuit 131 functionally added to the band-pass filter 112 of FIG. 15 for compensating the base current of the npn transistor 112 of the impedance conversion circuit 111. In reflecting this change the band-pass filter of Embodiment 5, corresponding to the band-pass filter 112 in FIG. 15, is referred to as the band-pass filter 132, and the ion current detection device of Embodiment 5, corresponding to the ion current detection device 113 in FIG. 15, is referred to as the ion current detection device 133. The base current compensation circuit 131 is also referred to as the circuit compensation portion.

Referring to FIG. 17, the band-pass filter 132 comprises an non-inverting amplifier circuit 54, a notch filter 61, an impedance conversion circuit 111, and a base current compensation circuit 131. The base current compensation circuit 131 includes pnp transistors 135 and 136, an npn transistor 137, and a constant-current source 138, the pnp transistors 135 and 136 forming a current mirror circuit.

The bases of the pnp transistors 135 and 136 of the base current compensation circuit 131 are coupled together and connected to the collector of the pnp transistor 136. The emitter of the pnp transistor 135 is connected to the power supply voltage terminal VCC, and its collector is connected to the base of the npn transistor 112 of the impedance conversion circuit 111. The emitter of the pnp transistor 136 is also connected to the power supply voltage terminal VCC, and its collector is connected to the base of the npn transistor 137. The collector of the npn transistor 137 is connected to the power supply voltage terminal VCC, and its emitter is grounded through the constant-current source 138.

In the above configuration the input bias current of the impedance conversion circuit 111 flows from the notch filter 61 to the base of the npn transistor 112. The base current compensation circuit 131 can send the same amount of current from the pnp transistor 135 to the notch filter 61 to compensate the input bias current of the impedance conversion circuit 111.

The ion current detection device of Embodiment 5 of the present invention includes the base current compensation circuit 131 which can send a current of the same amount as the current flowing from the notch filter 61 to the impedance conversion circuit 111 to the output of the notch filter 61 or the output terminal E. Therefore, the present embodiment can provide the same effects as Embodiment 3. Further, the npn transistor used at the input of the impedance conversion circuit prevents the current which flows from the notch filter to the impedance conversion circuit from affecting the performance of the notch filter.

The filter characteristic controlling portion, according to the ion current detection device of the present invention, suppresses the sensitivity of the filter portion for detecting an ac signal with a specific frequency for a predetermined time right after the ion current threshold detection circuit sends an ion current detection signal. After the predetermined time, the filter characteristic controlling portion increases the sensitivity of the filter portion for detecting an ac signal with the specific frequency. This scheme prevents the ion current detection device's falsely detecting the knocking state by eliminating the effect of the ringing and produces an ion current detection device with a simplified and smaller circuit at a reduced cost. Further, this scheme improves both the conflicting requirements: reduction of the ringing occurring at the filter portion and enhancement of the detection sensitivity of the ac knocking signal superimposed on the ion current. This scheme also enables the knocking signal to be detected within a short time after the ion current is generated.

The ion current/voltage conversion portion, comprising a diode and an ion current detection portion for detecting an ion current, produces, by means of the logarithmic forward bias characteristic of the diode, a voltage signal which is proportional to the ac components of the ion current detected by the ion current detection portion. This configuration prevents the ion current detection device's falsely detecting the knocking state by eliminating the effect of the ringing and produces an ion current detection device with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated.

The ion current detection device comprising an ion current detecting portion formed with a current mirror circuit prevents false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated.

If the filter portion is a band-pass filter comprising a non-inverting amplifier portion, a notch filter circuit portion placed within the negative feedback loop for the non-inverting amplifier portion, and a buffer circuit portion for transmitting an output signal from the notch filter circuit portion back to the non-inverting amplifier portion, the ion current detection device, including the filter portion with the above configuration, prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated.

If the filter characteristic control portion keeps the attenuation of the notch filter circuit portion for the signal with a specific frequency low for a predetermined time right after the ion current threshold detection portion sends an ion current detection signal, and if the filter characteristic control portion, after the predetermined time, increases the attenuation of the notch filter circuit portion for the signal with the specific frequency, the ion current detection device, including the aforementioned filter characteristic controlling portion, prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated.

The ion current detection device comprising a buffer circuit portion including a voltage follower formed with an operational amplifier prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated.

The ion current detection device comprising a buffer circuit portion including an impedance conversion circuit formed with a transistor circuit prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated and suppresses oscillation in spite of its simple circuit configuration.

The ion current detection device comprising an impedance conversion circuit including an npn transistor at the input thereof prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated and suppresses oscillation in spite of its simple circuit configuration. This configuration reduces the voltage difference between the input and output terminals of the notch filter portion and thus reduces the capacitances of the capacitors used in the notch filter portion resulting at a reduced cost for the ion current detection device.

The ion current detection device further comprising a compensation circuit portion for compensating an input bias current of the impedance conversion circuit prevents a false detection of the knocking state by eliminating the effect of the ringing and can be produced with a simplified and smaller circuit at a reduced cost. Further, this configuration improves both the conflicting requirements: reduction of the ringing occurring at the filter portion and enhancement of the detection sensitivity of the ac knocking signal superimposed on the ion current. This configuration also enables the knocking signal to be detected within a short time after the ion current is generated and suppresses oscillation in spite of its simple circuit configuration. This configuration reduces the voltage difference between the input and output terminals of the notch filter portion and thus enables capacitors of lower capacitances to be used in the notch filter portion thus resulting in a cost reduction of the ion current detection device. Further, this configuration eliminates the interference of the input bias current of the impedance conversion circuit on the notch filter portion.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ion current detection device used in an internal combustion engine comprising:

a detection voltage generation circuit for applying a voltage to an ignition plug to generate an ion current;

a current to voltage conversion circuit for converting the generated ion current to a corresponding voltage; a bandpass filter, having controllable filter characteristics, for extracting an ac component within a specified frequency band from a voltage signal output by said current to voltage conversion circuit;

an ion current threshold detection circuit for outputting a detection signal when the generated ion current exceeds a predetermined threshold current; and a filter characteristic control circuit for controlling the filter characteristics of said bandpass filter, said filter characteristic control circuit suppressing the detection sensitivity of said bandpass filter for the ac component within said frequency band for a predetermined period of time after said ion current threshold detection circuit outputs the detection signal, and increasing the detection sensitivity of said bandpass filter after said predetermined period of time.

2. The ion current detection device of claim 1 wherein said current to voltage conversion circuit comprises:

an ion current detection circuit; and a diode;

wherein said current to voltage conversion circuit outputs a voltage signal proportional to the ac component of the ion current detected by said ion current detection circuit.

3. The ion current detection device of claim 2 wherein said ion current detection circuit comprises a current mirror circuit.

4. The ion current detection device of claim 1 wherein said band-pass filter comprises:

a non-inverting amplifier having a negative feedback loop;

a notch filter circuit placed within the negative feedback loop of said non-inverting amplifier; and a buffer circuit for transmitting an output signal from said notch filter circuit back to said non-inverting amplifier.

5. The ion current detection device of claim 4 wherein said filter characteristic control circuit keeps the attenuation of said notch filter circuit for the signal within the specified frequency band low for said predetermined period of time after said ion current threshold detection circuit outputs the ion current detection signal, and then, after said predetermined period of time, increases the attenuation of said notch filter circuit for the signal within the specified frequency band.

6. The ion current detection device of claim 4 wherein said buffer circuit includes a voltage follower formed with an operational amplifier.

7. The ion current detection device of claim 4 wherein said buffer circuit includes an impedance conversion circuit formed with a transistor circuit.

8. The ion current detection device of claim 7 wherein said impedance conversion circuit includes an npn transistor at the input thereof.

9. The ion current detection device of claim 7 further comprising a compensation circuit for compensating an input bias current of said impedance conversion circuit.

10. A method of detecting an ion current in an internal combustion engine comprising:

applying a voltage to an ignition plug to generate an ion current;

converting the generated ion current to a corresponding voltage signal;

filtering the corresponding voltage signal using a bandpass filter to extract an ac component within a specified frequency band;

outputting a detection signal when the generated ion current exceeds a threshold; and controlling the filtering characteristics of the bandpass filter to suppress sensitivity of the bandpass filter to the ac component within the specified frequency band for a period of time after said outputting step outputs the detection signal, and increasing sensitivity of the bandpass filter to the ac component within the specified frequency band after the period of time.

11. The method of claim 10, wherein the bandpass filter includes a notch filter circuit, and said controlling step suppresses attenuation characteristics of the notch filter circuit for the ac component within the specified frequency band low for the period of time after said outputting step outputs the detection signal, and increases the attenuation characteristics of the notch filter circuit after the period of time.

12. An ion current detection apparatus of an internal combustion engine comprising:

a detection circuit for outputting a detection signal when an ion current generated by the engine exceeds a threshold;

a bandpass filter, having variable filtering characteristics, for extracting an ac component within a specified frequency band from a signal representing the ion current generated by the engine;

a filter characteristic control circuit for decreasing a detection sensitivity of said bandpass filter for the ac component within the specified frequency band for a period of time after said detection circuit outputs a detection signal, and increasing detection sensitivity of said bandpass filter for the ac component within the specified frequency band after the period of time.

13. The apparatus of claim 12, further comprising:

a current to voltage converting circuit for converting the ion current generated by the engine into a corresponding voltage.

14. The apparatus of claim 12, wherein said bandpass filter comprises:

a non-inverting amplifier having a negative feedback loop;

a notch filter circuit positioned in the negative feedback loop of said non-inverting amplifier; and a buffer circuit for transmitting an output signal from said notch filter circuit to said non-inverting amplifier.

15. The apparatus of claim 14, wherein said filter characteristic control circuit suppresses the attenuation characteristics of said notch filter circuit for the ac component within the specified frequency band low for the period of time after said detection circuit outputs the detection signal, and increases the attenuation characteristics of said notch filter circuit for the ac component within the specified frequency band after the period of time.

16. The apparatus of claim 14, wherein said buffer circuit includes a voltage follower.

17. The apparatus of claim 14, wherein said buffer circuit includes an impedance conversion circuit.

* * * * *